US006524424B2

(12) United States Patent
Edwards et al.

(10) Patent No.: US 6,524,424 B2
(45) Date of Patent: Feb. 25, 2003

(54) COMBINED SOIL REINFORCEMENT AND DRAINAGE GRID

(75) Inventors: Terence John Edwards, Dewsbury (GB); Michael King McCreath, Tewkesbury (GB)

(73) Assignee: Linear Composites Limited, West Yorkshire (GB)

( * ) Notice: Subject to any disclaimer, the term of this patent is extended or adjusted under 35 U.S.C. 154(b) by 235 days.

(21) Appl. No.: 09/732,356

(22) Filed: Dec. 7, 2000

(65) Prior Publication Data

US 2001/0004917 A1 Jun. 28, 2001

(30) Foreign Application Priority Data

Dec. 11, 1999 (GB) ..... 9929249

(51) Int. Cl.[7] ..... E02B 11/00

(52) U.S. Cl. ..... 156/292; 156/73.1; 156/177; 156/148; 156/308.2; 156/290; 405/302.7; 405/36; 405/43

(58) Field of Search ..... 405/302.7, 36, 405/43; 156/73.1, 73.4, 148, 177, 290, 292, 308.2, 308.4

(56) References Cited

U.S. PATENT DOCUMENTS 5,558,689 A * 9/1996 Yanagihara et al. ..... 55/492

6,312,190 B1 * 11/2001 Goughnour ..... 210/170

FOREIGN PATENT DOCUMENTS

GB 2089464 A * 6/1982 ..... F16F/7/12
GB 2283687 A * 5/1995 ..... A63B/67/18

* cited by examiner

*Primary Examiner*—Sam Chuan Yao
(74) *Attorney, Agent, or Firm*—Howard & Howard

(57) ABSTRACT

A method of producing a drainage grid or network comprising a number of interlocked strips is disclosed which comprises providing a warp direction a plurality of strips having a channel or channels formed longitudinally therein, feeding such strips into a bonding zone wherein a filter material is bonded over the channel or channels, subsequently providing strips of polymeric material transverse to the warp strips and bonding them thereto to form the weft of the network and thereafter collecting the network or grid so produced. The warp and weft may be produced from yarn reinforced polymeric webbing which is heat bonded to give a mesh. It has been found that polyolefin materials, particularly polyethylene, are suitable. Where reinforcing is provided this may be in the form of reinforcing polyester yarns and are preferably inserted in the longitudinal direction in bundles. The filter fabric may also be a thermoplastic material and may be heat bonded, needle punched or woven. The filter fabric is adhered to, preferably by hot bonding, the warp using an elevated temperature and pressure.

14 Claims, 2 Drawing Sheets

COMBINED SOIL REINFORCEMENT AND DRAINAGE GRID

BACKGROUND OF THE INVENTION

This invention relates to a combined soil reinforcement and drainage grid and in particular relates to a process of making the same.

Soil reinforcement grids or networks of synthetic polymeric material are known for the stabilisation of soil in construction sites and the like. It has been proposed to incorporate a drainage means within such a grid to aid drainage of the soil for quickly draining rain water and accumulated underground water thereby alleviating hydraulic pressure exerted on the ground, increasing ground stability and preventing earth movement from occurring on a construction site.

The present invention seeks to provide a simple and convenient process for producing such grids of polymeric material in an economical manner.

SUMMARY OF THE INVENTION

According to the present invention there is provided a method of producing a drainage grid or network comprising a number of interlocked strips which comprises providing a warp direction a plurality of strips having a channel or channels formed longitudinally therein, feeding such strips into a bonding zone wherein a filter material is bonded over the channel or channels, subsequently providing strips of polymeric material transverse to the warp strips and bonding them thereto to form the weft of the network and thereafter collecting the network or grid so produced.

The collection is conveniently carried out by winding the so-produced network onto a roll.

When bonding the weft strips to the warp strips carrying the filter material and channels, care should be taken to avoid crushing the channels and/or bonding the filter material down into the base of the channels. Accordingly, it is preferred the weft is bonded to the warp only in those areas adjacent the channel or channels.

The warp and weft may be produced from yarn reinforced polymeric webbing which is heat bonded to give a mesh. It has been found that polyolefin materials, particularly polyethylene, are suitable. Where reinforcing is provided this may be in the form of reinforcing polyester yarns and are preferably inserted in the longitudinal direction in bundles.

The filter fabric may also be a thermoplastic material and may be heat bonded, needle punched or woven. The filter fabric is adhered to, preferably by hot bonding, the warp using an elevated temperature and pressure.

The process is preferably carried out in a machine which may advantageously be operated in a step-wise manner so that each warp strip is bonded to a length of filter fabric and then the machine indexed forward for the next stage. The length of step chosen is preferably that between adjacent wefts so that indexing the strips forward one unit places the warp in position for both the next filter bonding stage as well as the next weft attachment stage.

The bonding of the filter fabric to the warp is a critical part of the invention. The bonding unit preferably hot bonds the filter fabric to the surface of the warp to provide a satisfactory continuous bond without destroying the structure of the filter fabric. This is done by ensuring that the combination of bonding temperature, bonding time, bonding pressure and bonding anvil material are controlled. The dominating parameter is bonding pressure. By using a pressure, for example, in the range 0.3 to 0.7 N/mm$^2$ the temperature can be reduced so as not to melt or shrink the filter fabric, and the bonding time can be controlled to give a satisfactory bond. The uniformity of the bond is determined by the hardness of the bonding anvil. It has been found that a synthetic rubber material with a shore hardness of 50° to 70° gives satisfactory results which compensate for variations in web and filter fabric thickness.

The invention will be described further, by way of example, with reference to the accompany drawings, in which:

DETAILED DESCRIPTION OF THE INVENTION

Figure 1:
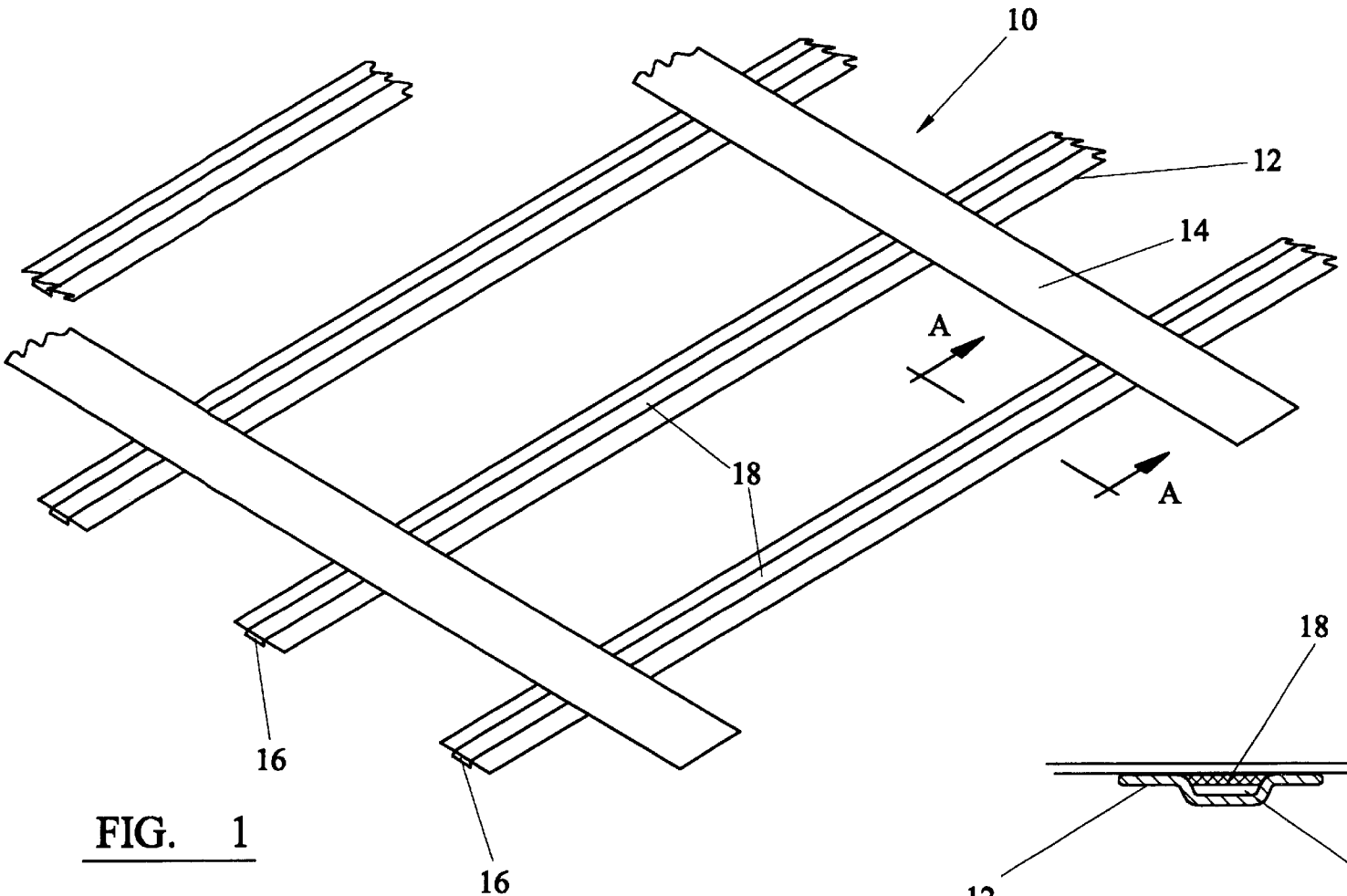
FIG. 1 is a perspective view of a drainage grid or network produced by the process of the invention.
Figure 2:
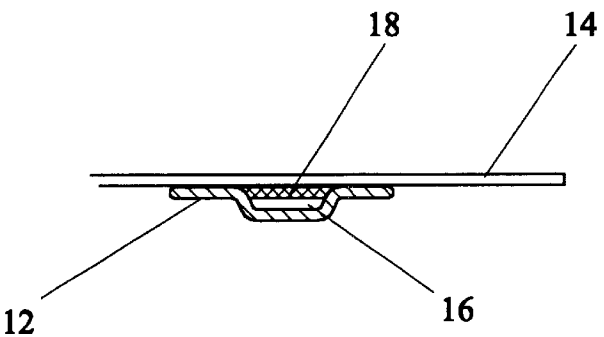
FIG. 2 is a cross-section on line AA of FIG. 1.

Referring to the drawings, it will be seen from FIGS. 1 and 2 that the drainage network generally designated 10 comprises warp strips 12 and weft strips 14 both of a synthetic polymer material, for example a polyolefine. The warp strips in particular and if desired also the weft strips 14 may be reinforced as is known per se with reinforcing yarns such as bundles of high tensile strength polyester fibres in the longitudinal direction.

The warp strips 12 are preformed with, or are heat treated to produce, a channel portion 16. Overlying the channel 16 is a filter fabric 18 allowing water access to the channel 16, while keeping out soil and other matter which would otherwise block the channel in use. The network is completed by weft strips 14 at intervals bonded to the warp 12.

Figure 3:
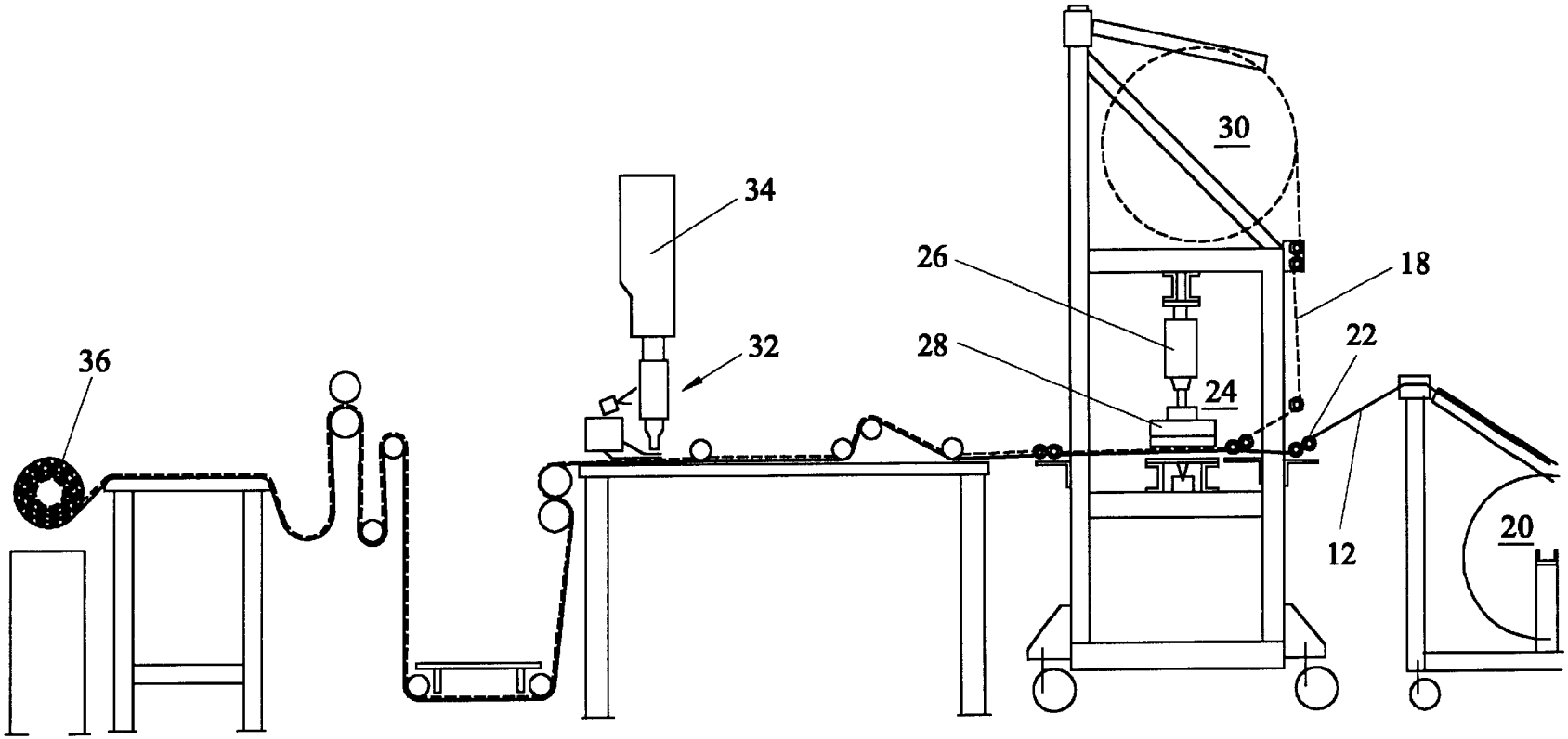
FIG. 3 is a diagrammatic elevation view of a suitable apparatus for carrying out the process of the invention.

Referring now more particularly to FIG. 3 the process of the invention will be described. Warp strips 12 are held on a creel 20 and are fed in, using a suitable feed roller arrangement 22, to the filter fabric bonding zone 24. The latter includes one or more pneumatic or hydraulic rams 26 and associated anvils 28 heated by a suitable means (not shown) to bond the filter material 18 provided from a suitable creel 30 to the warp 12. After leaving the bonding zone 24 the warp passes to a weft insertion and bonding area 32. Here weft strips 14 are fed transversely across the warp strips 12 and are bonded thereto in a manner known per se using a bonding unit 34. Care must be taken when bonding the weft 14 to the warp 12 not to crush the otherwise deform the channel 16. The weft bonding anvil can be relieved in the centre to achieve this end.

After leaving the weft bonding zone 32 the formed network is led through a series of rollers to a collection roll 36.

The invention will be illustrated further by the following example.

EXAMPLE

Using the apparatus of FIG. 3 a drainage network comprising an 80/15 grid was produced as follows. A grooved warp web 12 containing reinforcing polyester yarn in 10 bundles sheathed in a linear low molecular weight polyethylene matrix giving a web width of 25 mm with an embossed groove of 8 mm×1.5 mm. A filter fabric comprising a heat bonded non-woven fabric of 23 mm width and 0.7 mm thickness is hot bonded to the warp using a pressure of 0.53 $N/mm^2$, a temperature of 156° C., a bonding time of 12 seconds and an anvil hardness of 68° (shore). Thereafter warp strips 14 are bonded transversely thereto to complete the network.

The warp breaking strength is 6.0 kN and the warp pitch is 75 mm. The weft web comprised a similarly reinforced polyester reinforced low molecular weight polyethylene strip giving a web width of 25 mm and strength of 3.38 kN. The weft web is hot bonded to the warp strips at intervals of 225 mm.

The final network grid produced has a breaking load in the warp direction of 80 kN/m and in the weft direction of 15 kN/m.

The method of the invention produces in a simple and economical fashion a network suitable for soil stabilisation and drainage in construction sites and the like.

What is claimed is:

1. A method of producing a drainage grid or network comprising a number of interlocked strips which comprises providing in a warp direction a plurality of spaced apart strips, each strip has a channel or channels formed longitudinally therein, feeding such strips into a bonding zone wherein a filter fabric is bonded over the channel or channels, subsequently providing strips of polymeric material transverse to the warp strips and bonding them thereto to form the weft of the network and thereafter collecting the network or grid so produced.

2. A method as claimed in claim 1 wherein the collection is carried out by winding the so-produced network onto a roll.

3. A method as claimed in claim 1 wherein the weft is bonded to the warp only in those areas adjacent the channel or channels.

4. A method as claimed in claim 1 wherein the warp and weft is produced from yarn reinforced polymeric webbing which is heat bonded to give a mesh.

5. A method as claimed in claim 4 wherein the polymeric material is a polyolefin material, particularly polyethylene.

6. A method as claimed in claim 4 wherein the reinforcing is in the form of reinforcing polyester yarns which are inserted in the longitudinal direction in bundles.

7. A method as claimed in claim 1 wherein the filter fabric is a thermoplastic material and is heat bonded, needle punched or woven.

8. A method as claimed in claim 7 wherein the filter fabric is adhered to the warp using an elevated temperature and pressure.

9. A method as claimed in claim 1 carried out in a machine which is operated in a step-wise manner so that each warp strip is bonded to a length of filter fabric and then the machine indexed forward for the next stage.

10. A method as claimed in claim 9 wherein the length of step chosen is that between adjacent wefts so that indexing the strips forward one unit places the warp in position for both the next filter bonding stage as well as the next weft attachment stage.

11. A method as claimed in claim 1 wherein the filter fabric is bonded to the surface of the warp to provide a satisfactory continuous bond without destroying the structure of the filter fabric.

12. A method as claimed in claim 11 wherein the combination of bonding temperature, bonding time, bonding pressure and bonding anvil material are controlled such that, employing a sufficiently high pressure, the temperature can be reduced so as not to melt or shrink the filter fabric, and the bonding time can be controlled to give a satisfactory bond.

13. A method as claimed in claim 12 wherein the bonding pressure is between 0.3 to 0.7 $N/mm^2$.

14. A method as claimed in claim 12 in which the bonding anvil is of a synthetic rubber material with a shore hardness of 50° to 70°.

* * * * *